US005527020A

United States Patent [19]

Ganesh et al.

[11] Patent Number: 5,527,020

[45] Date of Patent: Jun. 18, 1996

[54] DIFFERENTIALLY HEAT TREATED ARTICLE, AND APPARATUS AND PROCESS FOR THE MANUFACTURE THEREOF

[75] Inventors: Swami Ganesh, West Chester; Ronald G. Tolbert, Cincinnati, both of Ohio

[73] Assignee: General Electric Company, Cincinnati, Ohio

[21] Appl. No.: 473,797

[22] Filed: Jun. 7, 1995

Related U.S. Application Data

[62] Division of Ser. No. 295,980, Aug. 25, 1994, which is a continuation of Ser. No. 860,880, Mar. 13, 1992, abandoned.

[51] Int. Cl.[6] ..... C21D 1/62

[52] U.S. Cl. ..... 266/260; 266/258

[58] Field of Search ..... 266/258, 260, 266/249; 148/627, 628, 640, 641, 646, 675

[56] References Cited

U.S. PATENT DOCUMENTS

| | | | |
|---|---|---|---|
| 2,449,760 | 9/1948 | Bedford | 266/258 |
| 3,154,849 | 11/1964 | Dolch, Jr. | 29/528 |
| 3,363,304 | 1/1968 | Quinlan | 29/423 |
| 3,584,368 | 6/1971 | Sargent, Jr. | 29/424 |
| 3,741,821 | 6/1973 | Athey et al. | 148/675 |
| 3,885,294 | 5/1975 | Chaundy et al. | 29/420 |
| 4,654,091 | 3/1987 | Malley | 148/13.1 |
| 4,816,084 | 3/1989 | Chang | 148/13 |
| 4,820,353 | 4/1989 | Chang | 148/2 |
| 4,820,358 | 4/1989 | Chang | 148/13 |
| 4,867,812 | 9/1989 | Henry | 148/428 |
| 5,077,090 | 12/1991 | Sawyer | 427/241 |
| 5,100,050 | 3/1992 | Krueger et al. | 228/265 |
| 5,312,497 | 5/1994 | Mathey | 148/675 |

*Primary Examiner*—Scott Kastler

*Attorney, Agent, or Firm*—Andrew C. Hess; David L. Narciso

[57] ABSTRACT

Apparatus for differentially heat treating a turbine disk of a gas turbine engine so as to produce a dual property superalloy disk. The apparatus enables a process to achieve substantially uniform yet different temperatures in the rim and hub of the disk during heat treatment, so as to attain specific and different properties for the rim and hub. The process includes the steps of heat treating the entire disk to achieve a uniform structure having a fine grain size and fine precipitates. A device for heating the rim of the disk is then disposed at the disk's periphery, such that the rim is maintained at a substantially uniform temperature above the gamma prime solvus temperature of the superalloy so as to dissolve gamma prime precipitates present in the rim and cause grain growth in the rim. The hub is thermally insulated from the heating device and cooled with an apparatus that enables the hub to be maintained at a substantially uniform temperature that is below the gamma prime solvus temperature of the superalloy. This apparatus insulates and cools the hub such that a temperature gradient is established in the web portion of the disk between the rim and hub, yet substantially uniform temperatures are maintained in the rim and hub. Thereafter, the disk is quenched and then aged at a temperature sufficient to develop gamma prime precipitates in the rim. The resulting disk exhibits improved resistance to creep in the rim and improved tensile strength and low-cycle fatigue resistance in the hub.

7 Claims, 3 Drawing Sheets

DIFFERENTIALLY HEAT TREATED ARTICLE, AND APPARATUS AND PROCESS FOR THE MANUFACTURE THEREOF

CROSS REFERENCE TO RELATED APPLICATIONS

This is a divisional patent application of U.S. patent application Ser. No. 08/295,980 filed Aug. 25, 1994, which is a continuation patent application of U.S. application Ser. No. 07/860,880 filed Mar. 13, 1992, now abandoned.

This invention relates to articles in which different microstructures and properties are preferred for different portions of the article. In particular, this invention provides an article having such differences in structure and properties, together with an apparatus and a process for producing such an article.

BACKGROUND OF THE INVENTION

There are numerous instances where operating conditions experienced by an article, or a component of a machine, place differing materials property requirements on different portions of the article or component. Examples include a crankshaft in an internal combustion engine, a piston rod in a hydraulic cylinder, planetary gears for an automobile transmission or the metal head of a carpenter's claw hammer. In a crankshaft, the journals must have hardened surfaces to resist wear during operation, but the crankshaft must also be tough enough to withstand transients in loading. Similarly, a piston rod must have a hard surface to avoid nicks, which might otherwise cause leaks of hydraulic fluid, but toughness to withstand transients in loading is also needed. In these two examples, the requirements may be met by fabricating the parts from nodular iron, or a medium carbon steel, and then induction hardening the articles to obtain the hard surface layer in the desired portions of the articles. The depth of the hardened layer produced by induction hardening is frequently between about 0.03 inch to 0.10 inch. In each of these articles, the surface of the article is differentially austenized, typically within a fraction of a minute, and then quenched to develop a hard martensite surface, which then may be tempered as desired.

A planetary gear for an automobile transmission is typically made from a low carbon steel, masked, then carburized. A carburized surface layer, limited to unmasked portions of the surface and generally less than about 0.04 inch in depth, contains sufficient carbon that it becomes substantially harder than the core of the gear during subsequent heat treatment. The hard carburized layer provides wear resistance in the gear teeth, while retaining toughness in the interior of the gear. Although carburizing is sometimes an alternative to induction or flame hardening, it should be regarded as selective surface alloying, rather than differential heat treatment.

A hammer head must be able to withstand pounding against nail heads, but the claws must have sufficient toughness to withstand extracting nails from wood. In this example, the entire striking end of the steel hammer head is austenized, in a minute or two, and then the head is quenched and tempered. This example differs from the crankshaft in that the entire striking end of the hammer is differentially heat treated, rather than just a thin surface layer.

One common feature of the well-known differential heat treatment processes employed in these examples is that each is applied to iron-carbon alloys, where carbon is the atomic species essential to hardening. Because carbon atoms diffuse so rapidly in iron-carbon alloys, each differential heating process can be performed within a few minutes. There is sufficient latitude in austenizing that it is generally not necessary to accurately control the temperature distribution within the differentially heated portions of the articles. Thus, it is generally not necessary to make any provision in the process for keeping the portions of the articles not being heat treated cool.

A turbine disk for a gas turbine engine is an example of another type of article where different properties in various portions of the article are preferred. Such disks are typically made from nickel-base superalloys, because of the temperatures and stresses involved in the gas turbine cycle. In the hub portion where the operating temperature is somewhat lower, the limiting material properties are often tensile strength and low-cycle fatigue resistance. In the rim portion where the operating temperature is higher because of proximity to the combustion gases, resistance to creep and hold time fatigue crack growth (HTFCG) are often the limiting material properties. HTFCG is the propensity in a material for a crack to grow under cyclic loading conditions where the peak tensile strain is maintained at a constant value for an extended period of time. By contrast, in conventional low-cycle fatigue testing the peak tensile strain is reached only momentarily before reduction in the strain begins.

It has not heretofore been possible to conveniently and reliably heat treat a disk to obtain such a combination of different properties in the different regions of a disk. As a consequence, most turbine disks have been heat treated with a process designed to provide a compromise set of properties throughout the entire disk. The various conditions which, taken together, have created such a formidable problem for heat treating, include the following. The disk itself, particularly for a large aircraft gas turbine engine, is generally about 25 inches in diameter. The rim portion of a disk, which must have the same properties throughout its extent, is an annular ring whose dimension in both axial and radial directions is greater than about 2 inches. These dimensions indicate that a large volume of metal must be heated. The nickel-base superalloys must be heated to temperatures above about 2000° F., for times of two hours or longer, to achieve the structure which provides the improved creep and HTFCG resistance needed for this application. The hub portion of the disk, however, must be kept below about 1900° F. to avoid altering its structure and properties.

The preceding combination of problems has been so formidable that other approaches to developing turbine disks having different properties in their hub and rim portions have been developed. One such approach, which provides a dual alloy disk by forge enhanced bonding of two different alloys for the rim and hub portions of the disk, is described in U.S. Pat. No. 5,100,050, assigned to the assignee hereof, which is incorporated herein by reference. It is noted that while the present invention was developed to provide differential heat treatment, and the resulting differences in properties between different portions of an article, in an article comprised of a single alloy, it may also be advantageously employed in heat treating a dual alloy disk made by the referenced process, or by any other appropriate process, in which the rim and bore or hub must be heat treated at different temperatures to achieve optimum properties in each.

The present invention fulfills the need for a differentially heat treated article, and an effective apparatus and process for providing such an article, and provides related advantages.

SUMMARY OF THE INVENTION

The present invention provides a differentially heat treated article, such as a disk of the type employed in turbine sections of gas turbine engines, together with an apparatus and a process for accomplishing such differential heat treatment. As described herein, the present invention contemplates heating a rim portion of a disk to a substantially uniform temperature which is higher than the hub portion of the same disk, such that the material in the rim portion of the disk be given a different heat treatment, in this case at a higher temperature than the material in the hub portion of the disk. As a consequence of the difference in heat treatment temperatures, the mechanical properties developed in those two portions of the disk will be different.

In one embodiment of the present invention, a turbine disk is made from a nickel-base superalloy that can be hardened by the development of a precipitate of the gamma-prime phase. The disk is heat treated, using conventional technology, to achieve the properties required in the hub portion of the disk. Such requirements generally emphasize high tensile strength and resistance to low-cycle fatigue over creep and HTFCG resistance. The disk is then differentially heat treated to raise the temperature in its rim portion high enough to permit grain growth in the rim portion, while keeping the hub portion at a substantially uniform temperature which is low enough to prevent significant changes in the previously developed properties. The larger grain size thus developed in the rim portion of the disk generally improves the resistance to creep and HTFCG in the rim portion, which is frequently a significant advantage in turbine design.

A disk given such a differential heat treatment becomes a dual property disk. It is contemplated that such a heat treatment is applicable to a monolithic disk, where the entire disk is comprised of the same alloy, or to a dual alloy disk, where the rim and hub regions are comprised of different alloys.

The present invention provides an important advance in the art of differentially heat treated articles, and apparatus and process for manufacturing such articles. Other features and advantages of the present invention will be apparent from the following more detailed description of the invention, which, taken in conjunction with the accompanying Figures and Examples, illustrate, by way of example and not by way of limitation, the principles of the invention.

DETAILED DESCRIPTION OF THE INVENTION

Figure 1:
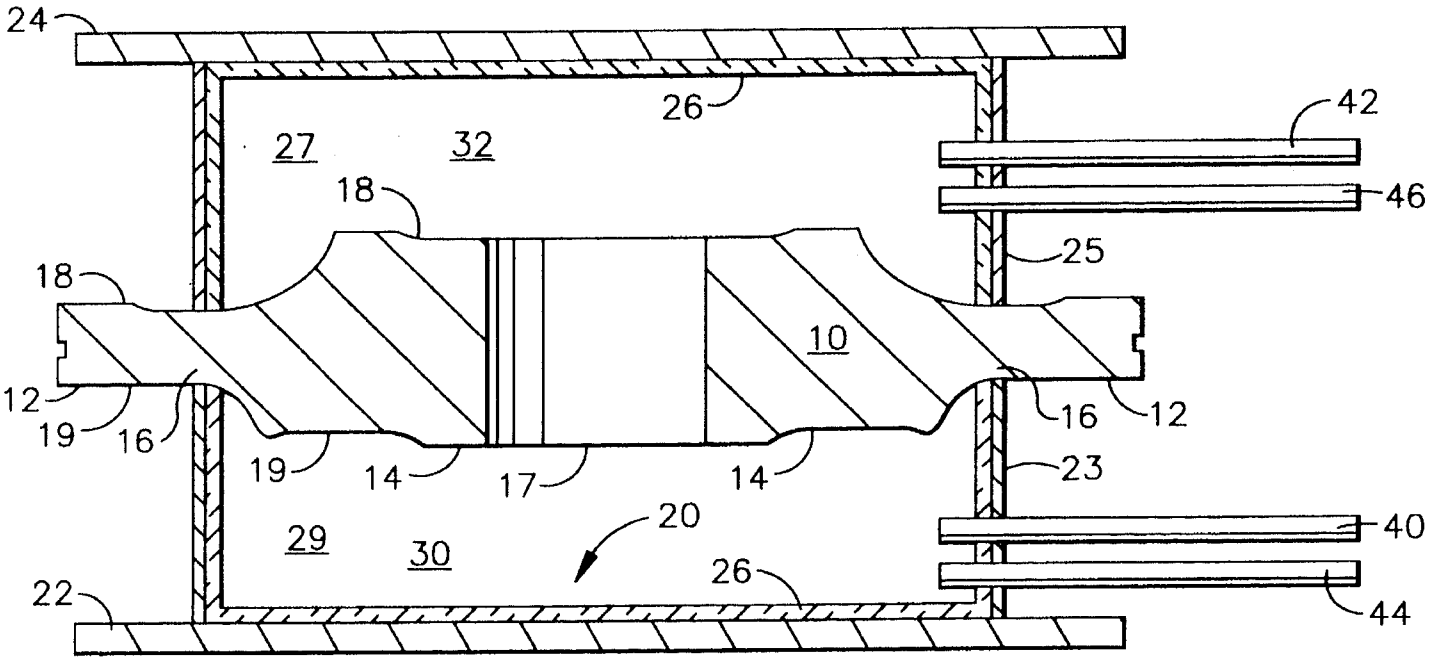
FIG. 1 is a schematic cross sectional view of a disk for a gas turbine engine and the apparatus used for differentially heat treating the disk.

The article of the present invention, and an apparatus useful in manufacturing that article are illustrated in FIG. 1. In the interest of clarity, both the article and the apparatus are shown in axisymmetric form in FIG. 1, even though such symmetry is not essential to the present invention. A turbine disk for a gas turbine engine is shown generally by 10; it is one type of article contemplated in the present invention. The disk is comprised of a rim portion, shown generally by 12, a hub portion, shown generally by 14, and a connecting or web portion, shown generally by 16. A central bore hole 17 through the hub portion 14 is generally an essential feature of a turbine disk, and facilitates heat treatment. The disk additionally comprises a first face 18 and a second face 19, each of which extends over the rim, web and hub portions on opposing sides of the disk.

The disk 10 and the heat treating apparatus, shown generally by 20, are configured and operated in such a manner as to achieve the desired properties in the rim 12 and hub 14 portions of the disk. In general, the disk is first heat treated, using a conventional heat treatment process, to achieve the desired properties in the hub portion. Typically, the operating temperature in the hub portion is below 1200° F. In this temperature range, representative disk materials, such as Rene'95, have ample creep and HTFCG resistance, and the limiting materials properties are tensile strength and low-cycle fatigue resistance. Rene'95 is a well-known nickel-base superalloy having a nominal composition, in weight percent, of 14% Cr, 8% Co, 3.5% Mo, 3.5% W, 3.5% Nb, 3.5% Al, 2.5% Ti, 0.15% C, 0.01% B, 0.05% Zr, balance Ni and incidental impurities.

However, operating temperatures in the rim portion of a disk frequently exceed 1200° F., and creep and HTFCG resistance are generally the limiting material properties. Thus, a metallurgical structure providing high resistance to creep and HTFCG is preferred in the rim portion. A coarse grain structure, which may be obtained through a supersolvus heat treatment, can provide greater resistance to creep and HTFCG than the fine grain structure frequently selected for the hub portion of the disk. The combination of structures which provides both high tensile strength and low-cycle fatigue in the hub portion and high resistance to creep and HTFCG in the rim portion can be achieved with a differential heat treatment, in which the rim and hub portions of the disk receive different heat treatments.

Apparatus for such differential heat treatment is illustrated in FIG. 1 at 20. The apparatus is comprised of a base 22 and a cap 24. Both portions are made from material which can withstand the intended heat treatment temperature of the rim portion 12 of the disk 10. The base 22 must be made from a material strong enough to support the combined weight of the disk 10 and the cap 24 at the heat treatment temperatures. Austenitic stainless steel has been found to be suitable for this application. The base and cap are configured such that a rim portion of each, 23 and 25, respectively, makes close contact with the web portion 16 of the disk on its lower and upper surfaces, 19 and 18, respectively. Both the base and the cap are lined with insulation 26. The hub of the disk is enclosed in the insulated interior 27, 29 formed when the disk is mounted between the base and the cap as shown in FIG. 1. The rim is positioned outside of the insulated interior 27, 29.

The base and cap of the apparatus are configured to provide plenums 30 and 32 between the disk and the base and between the disk and the cap, respectively. The apparatus also includes tubes 40 and 42 for supplying cooling gas to the lower and upper plenums, and tubes 44 and 46 to carry such gas away from the apparatus. In operation, the entire apparatus is placed within a box furnace (not shown) of a type well known in the art, with the tubes 40 through 46 extending through the wall of the box furnace. The box furnace supplies heat to the rim portion of the disk. Other means for heating the rim portion of the disk may be employed in the apparatus. The apparatus also includes means (not shown) for regulating the flow of cooling gas into tubes 40 and 42, so that a net flow of gas through the bore hole in the disk 17 may be achieved. The cooling gas which may be air, nitrogen or an inert gas, cools the hub portion of the disk.

Some type of control means (not shown) is used to maintain the temperature in the rim portion of the disk at a preselected value. One or more thermocouples might be attached to the rim portion of the disk, and the resulting electrical signals would be supplied to a controller, which would adjust the temperature within the box furnace. Alternatively, a radiation pyrometer could be used to supply the electrical signals to the controller. Another control means (not shown) is used to measure the temperature within the plenum portion of the apparatus, or in the hub portion of the disk, and to regulate the flow of air through the tubes 40 through 46 to provide the desired temperature differential. Although a variety of such control means are known to those skilled in the art, the use of such control means constitutes an essential part of the present invention.

Figure 2:
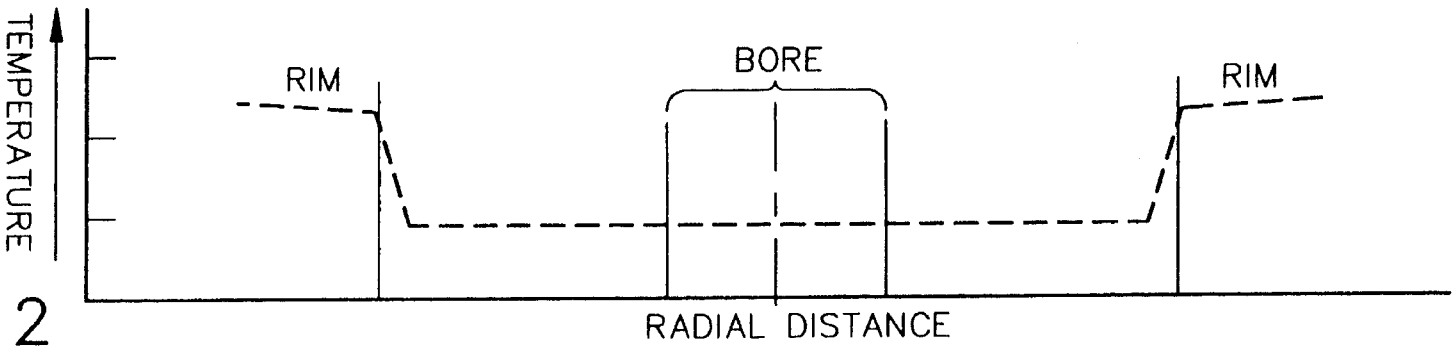
FIG. 2 is a schematic representation of the temperature distribution within the disk of FIG. 1.

The temperature distribution within a disk is shown schematically in FIG. 2. Using the apparatus of the present invention it has been possible to maintain a temperature differential between bore and rim regions of the disk in excess of 250° F. under steady state conditions for more than 3 hours.

Wrought nickel base superalloys are hardened by precipitation of the gamma-prime phase. Conventional processing of such alloys used for applications like turbine disks typically requires a solution heat treatment of the entire disk to a temperature in the vicinity of the gamma prime solvus temperature, preferably slightly below the gamma-prime solvus temperature, followed by quenching, typically in oil or a salt bath, and then aging to develop a gamma-prime precipitate. Depending on the starting structure, such a sequence would produce a fine grained structure that is frequently specified for turbine disks.

The differential heat treatment process of the present invention heat treats different portions of a wrought superalloy disk at different temperatures, and if desired, for different times. In the differential heat treatment process, the rim portion is heated to a temperature slightly above the gamma-prime solvus temperature and held, thereby dissolving all of the gamma-prime particles in the rim portion; at these elevated temperatures for the appropriate time the grain size can grow substantially. The disk is then quenched, typically by first removing the apparatus and disk from the furnace, then removing the cap from the apparatus, and finally quenching the disk as desired. The entire disk is then aged at a temperature well below the solutioning temperature, but sufficiently high to precipitate the fine strengthening phase, typically gamma prime. The coarser grain structure of the rim provides improved creep and HTFCG resistance. No substantive changes in structure or properties occur in the hub portion. This arrangement produces a hub portion which is already cooler than the rim portion as quenching is initiated. Although the differential heat treat process of the present invention is described in terms of a wrought alloy starting material, the process is equally useful and produces substantially the same results when the starting material is a powdered material part (p/m), such as p/m turbine disks fabricated by HIP. Both the wrought processing and the p/m processing yield the fine-grained part required to successfully differentially heat treat a turbine disk.

In the normal heat treatment of a disk, the temperature distribution during quenching is just the opposite of that shown in FIG. 2. If a bore is present at the centerline, the pattern will be somewhat modified. However, the hub region generally is at a higher temperature during a conventional quench and cools more slowly than the rim.

In the context of the present invention it is useful to distinguish among the rim portion 12, the hub region 14 and web region 16 on the basis of metallurgical structure and temperatures achieved during differential heat treatment, rather than on the basis of configuration of the disk. As indicated above, one object of a differential heat treatment is producing an article which has different properties in different portions of the article, for example, the rim and hub portions of the disk. The apparatus and process of the present invention are specifically designed to produce a dual property disk. Thus, it is logical to identify the hub portion 14 as that portion of the disk which is kept cool enough during the differential heat treatment process so that no substantive changes occur in the metallurgical structure or properties developed in the hub portion during the previous heat treatment. It is also logical to identify the rim portion 12 as that portion of the disk which is differentially heat treated to achieve those properties deemed appropriate therein. In the preferred form of the present invention, the temperature during differential heat treatment is substantially uniform throughout the cross-section of the rim portion, from the first face 18 to the second face 19, and the structure and properties developed as a result of the heat treatment are likewise substantially uniform. In this respect the rim portion of the disk of the present invention is clearly distinct from the surface layer in induction hardened articles, where only the thin surface layer is heated and subsequently quenched. The web portion 16 is the portion of the disk that lies between the rim and hub portions, and is not a part of either the rim or hub portion. There will necessarily be a temperature gradient in the web portion during the differential heat treatment and, due to the construction of the apparatus 20, the temperature gradient in the web portion 16 will be greater than the temperature gradients in the rim portion 12 and the hub portion 14, as depicted in FIG. 2. A variation in properties within the web region is to be expected, but is inconsequential in terms of overall performance of the disk.

In another form of the present invention, the entire differential heat treatment apparatus 20, including the article to be heat treated 10, is placed in an inert gas environment. The coolant circulating through the plenums and the supply and exhaust tubes is also an inert gas. In this form of the invention, the article to be heat treated 10 and the apparatus 20 are protected from oxidation during the differential heat treatment process, which is carried out completely in an inert gas atmosphere.

In yet another form of the present invention, a conventionally heat treated part, such as a turbine disk made of either a single alloy or a dual alloy, can be differentially aged to achieve different microstructures in different portions of the article. For example, after a part such as a disk is solutioned and quenched, in order to achieve a coarse precipitate in the rim portion and a fine precipitate in the hub portion, the rim portion is aged at a higher temperature than normal, for example, 1525° F. versus 1400° F. for Rene'95, while the hub is held at a lower temperature, preferably below the 1400° F. temperature, if possible, so that no precipitate forms in the hub. This develops the overaged precipitate in the rim portion. The entire disk is then given the standard lower temperature heat treatment, for Rene'95, about 1400° F., which develops a fine precipitate in the hub portion. This differential aging produces a rim portion suitable for higher temperature operation and better creep capabilities having overaged gamma prime and fine gamma prime, while the hub portion having only a fine gamma prime is better suited to withstand high tensile loads and low cycle fatigue.

EXAMPLE 1

Figure 3:
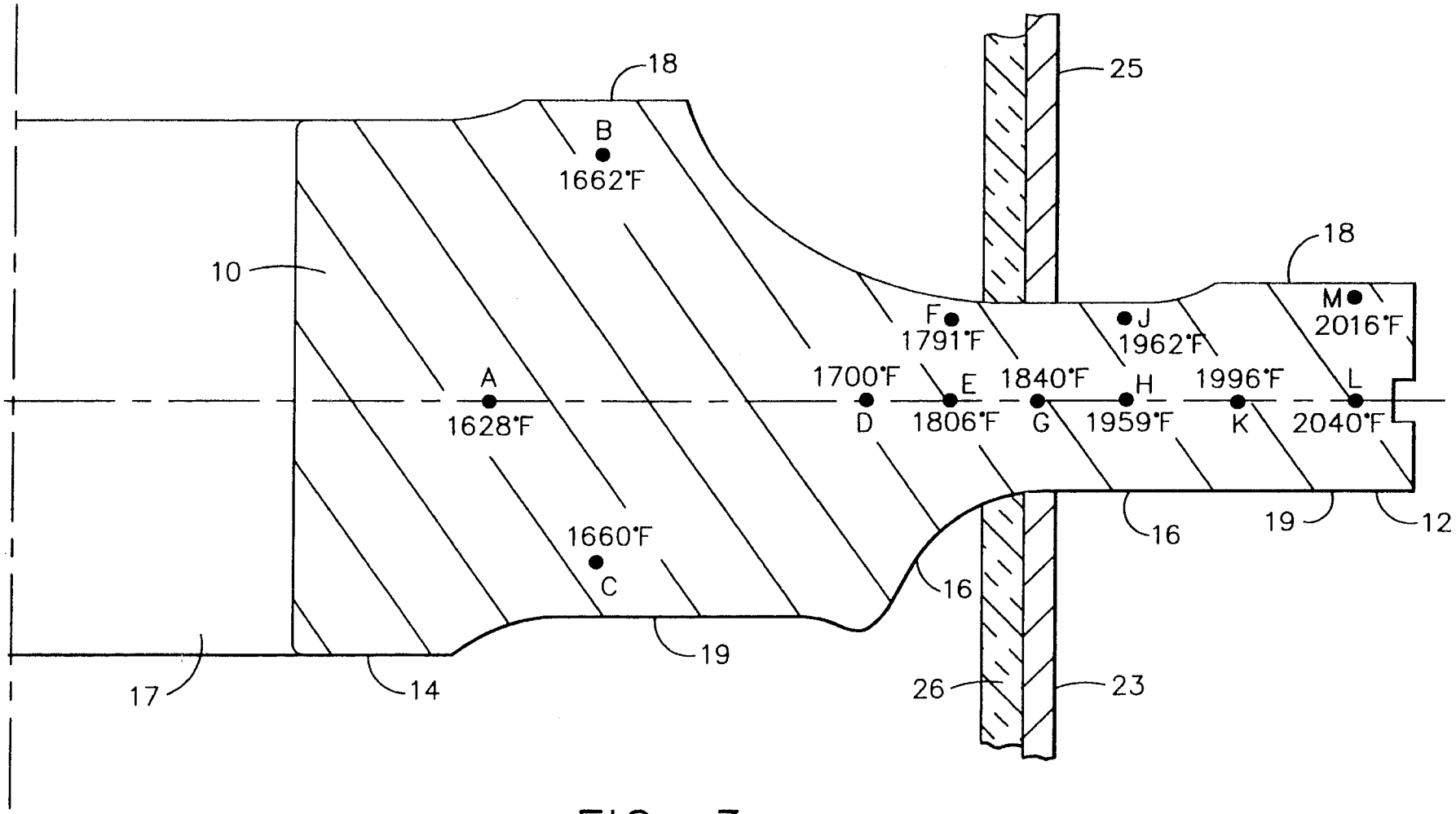
FIG. 3 illustrates the locations of twelve thermocouples in the disk forging described in Example 1.
Figure 4:
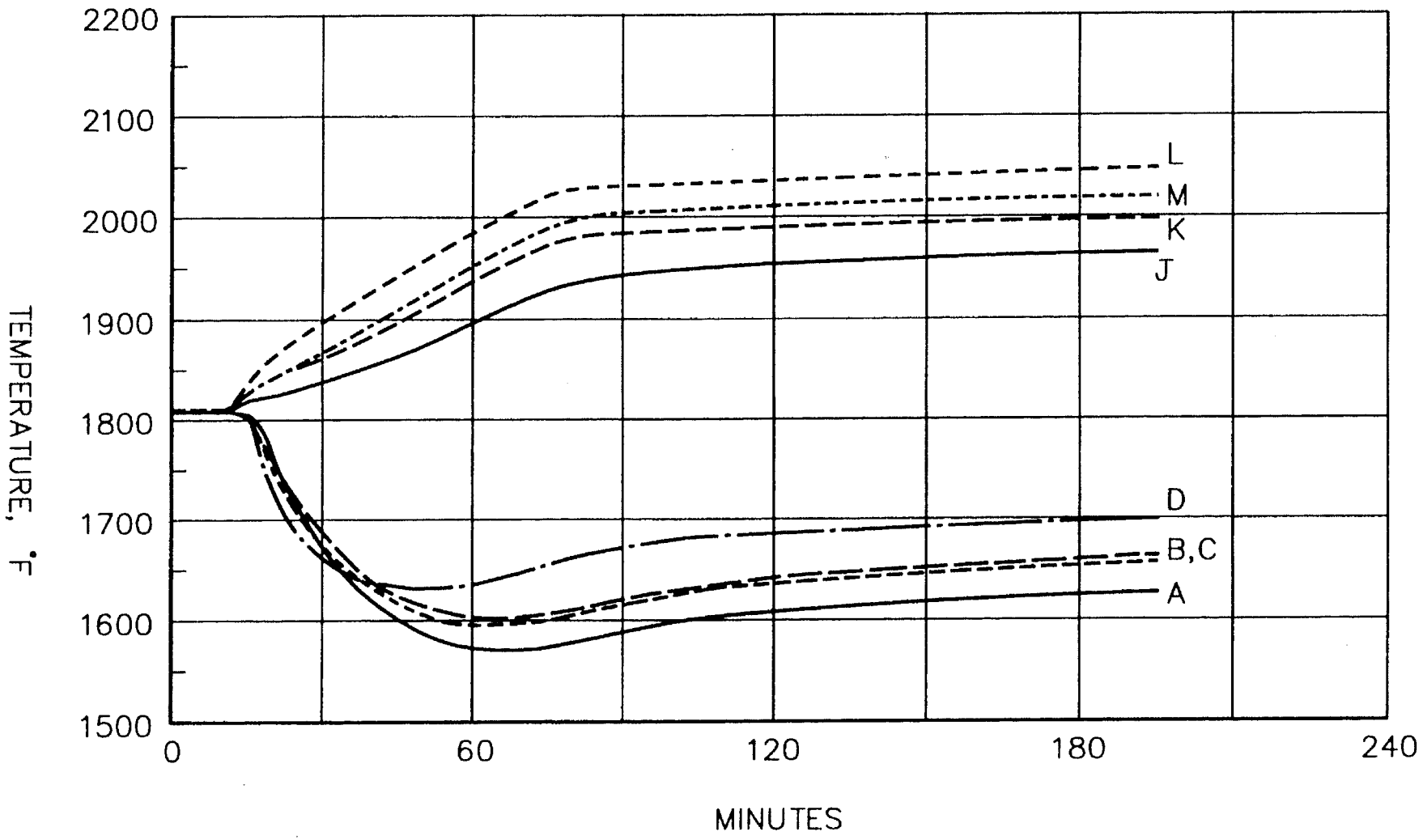
FIG. 4 shows the temperatures at various locations in the disk during the experiment described in Example 1.

Several thermocouples were embedded in a disk forging made of the well-known nickel-base superalloy Inconel 718 at the locations indicated in FIG. 3. The disk forging had a diameter of about 25 inches, a rim thickness of about 2 inches, and a hub thickness of about 4.5 inches. The disk was first heated to a uniform temperature of about 1800° F. then the disk was differentially heat treated to a rim temperature of about 2020° F. and a hub temperature of about 1650° F. Temperature uniformity in the rim portion between its periphery and the web portion was within about 50° F. The temperatures at each of eight thermocouple locations during the progress of the experiment are given in FIG. 4. The temperatures measured 180 minutes after the start of the experiment are shown at the corresponding thermocouple locations in FIG. 3. Thermocouples A, B and C were in the hub region; thermocouples D through J were in the web and thermocouples K, L and M were in the rim.

In light of the foregoing discussion, it will be apparent to those skilled in the art that the present invention is not limited to the embodiments, methods and compositions herein described. Numerous modifications, changes, substitutions and equivalents will become apparent to those skilled in the art, all of which fall within the scope contemplated by the invention.

What is claimed is:

1. An apparatus for differentially heat treating a superalloy disk for a gas turbine engine to obtain a dual property disk, the disk comprising a rim portion and a hub portion, a web portion between the rim and hub portions, a bore within the hub portion, a periphery, and a first face and a second face on opposite sides of the disk, the apparatus comprising:

heating means, disposed around the rim portion of the disk, for providing heat to the periphery and the first and second faces of the rim portion;

controlling means for maintaining the rim portion of the disk at a substantially uniform first elevated temperature;

means for thermally insulating the hub portion of the disk from heat provided by the heating means, the insulating means comprising a means for enclosing the hub portion so as to physically isolate the hub portion from the heating means, the disk dividing the enclosing means to define a first cavity facing the first face of the disk and a second cavity facing the second face of the disk, the bore of the hub portion forming a passage between the first and second cavities; and means for cooling the hub portion of the disk, the cooling means causing a cooling medium to be introduced to and removed from the first and second cavities.

2. The apparatus of claim 1, wherein the apparatus is configured to maintain a steady state temperature within the hub portion at least 100° F. below the first elevated temperature within the rim portion of the disk.

3. The apparatus of claim 1, wherein the means for cooling further comprises means for selectively causing at least a portion of the cooling medium to flow from the first cavity, through the bore in the hub portion, and into the second cavity from which the portion of the cooling medium is then removed from the apparatus.

4. The apparatus of claim 1, additionally comprising means for excluding atmospheric air from the disk.

5. The apparatus of claim 4 wherein the means for excluding air includes means for circulating an inert gas coolant through the first and second cavities adjacent the first and second faces of the hub portion of the disk and means for circulating an inert gas adjacent the rim portion of the disk.

6. The apparatus of claim 1, wherein the apparatus and the disk are axisymmetric.

7. The apparatus of claim 1, wherein the heating means is configured to maintain the temperature of the rim portion of the disk above a gamma-prime temperature of the superalloy disk.

* * * * *